US006446584B1

(12) United States Patent
Franke et al.

(10) Patent No.: US 6,446,584 B1
(45) Date of Patent: Sep. 10, 2002

(54) FOSSIL-FUEL-FIRED STEAM GENERATOR

(75) Inventors: Joachim Franke, Altdorf; Rudolf Kral, Erlangen, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/907,760

(22) Filed: Jul. 18, 2001

Related U.S. Application Data

(63) Continuation of application No. PCT/DE00/00055, filed on Jan. 10, 2000.

(30) Foreign Application Priority Data

Jan. 18, 1999 (DE) ..... 199 01 621

(51) Int. Cl.[7] ..... F22G 3/00
(52) U.S. Cl. ..... 122/460; 122/459; 122/6 A
(58) Field of Search ..... 122/1 B, 1 C, 122/4 D, 6 A, 406.3, 406.4, 459, 460, 451 S

(56) References Cited

U.S. PATENT DOCUMENTS

| | | | | |
|---|---|---|---|---|
| 3,043,279 A | | 7/1962 | Blomquist | |
| 4,160,009 A | * | 7/1979 | Hamabe | 122/4 D |
| 4,465,021 A | * | 8/1984 | Richter et al. | 122/4 D |
| 4,665,865 A | * | 5/1987 | Zubrod | 122/6 A |
| 5,353,749 A | | 10/1994 | Seibel et al. | |

FOREIGN PATENT DOCUMENTS

| | | |
|---|---|---|
| AT | 376 026 | 10/1984 |
| DE | 938 643 | 5/1966 |
| DE | 4431185 A1 | 3/1996 |
| EP | 0450072 A1 | 10/1991 |
| WO | PCT/DE99/01550 | 12/1999 |

OTHER PUBLICATIONS

J.Franke et al.: "Verdampfkonzepte für Benson–Dampferzeuger" [Evaporator concepts for Benson steam Generators], published in VGB Kraftwerkstechnik 73 (1993), No. 4, pp. 352–360.

* cited by examiner

*Primary Examiner*—Gregory Wilson
(74) *Attorney, Agent, or Firm*—Laurence A. Greenberg; Werner H. Stemer; Gregory L. Mayback

(57) ABSTRACT

A steam generator has an especially simple structural concept of a combustion chamber for a predetermined output range and for various qualities of different fossil fuels. The steam generator includes a first combustion chamber and a second combustion chamber which have a respective number of burners for fossil fuel and are constructed for an approximately horizontal main flow direction of heating gas. The first combustion chamber and the second combustion chamber open into a common horizontal gas flue connected upstream of a vertical gas flue on the heating-gas side.

40 Claims, 4 Drawing Sheets

FOSSIL-FUEL-FIRED STEAM GENERATOR

CROSS-REFERENCE TO RELATED APPLICATION

This application is a continuation of copending International Application No. PCT/DE00/00055, filed Jan. 10, 2000, which designated the United States.

BACKGROUND OF THE INVENTION

Field of the Invention

The invention relates to a steam generator having a first and a second combustion chamber with a respective number of burners for fossil fuel.

In a power plant having a steam generator, the energy content of a fuel is utilized for evaporating a flow medium in the steam generator. The steam generator has evaporator tubes which are heated, leading to evaporation of the flow medium conducted therein in order to evaporate the flow medium. Steam provided by the steam generator may in turn be used, for example, for a connected external process or for driving a steam turbine. If the steam drives a steam turbine, a generator or a driven machine is normally operated through a turbine shaft of the steam turbine. In the case of a generator, the current generated by the generator can be provided for feeding into an interconnected and/or separate network.

In that case, the steam generator may be constructed as a once-through steam generator. A once-through steam generator has been disclosed by a paper entitled "Verdampferkonzepte fur Benson-Dampferzeuger" [Evaporator Concepts For Benson Steam Generators] by J. Franke, W. Köhler and E. Wittchow, published in VGB Kraftwerkstechnik 73 (1993), No. 4, pages 352–360. In a once-through steam generator, the heating of steam-generator tubes provided as evaporator tubes leads to evaporation of the flow medium in the steam-generator tubes in a single pass.

Once-through steam generators are normally constructed with a combustion chamber in a vertical type of structure. That means that the combustion chamber is constructed for a throughflow of a heating medium or heating gas in an approximately vertical direction.

In that case, a horizontal gas flue can be connected downstream of the combustion chamber on the heating-gas side. The heating-gas flow is deflected into an approximately horizontal flow direction at a transition from the combustion chamber into the horizontal gas flue. However, due to temperature-induced changes in length of the combustion chamber, the combustion chamber generally requires a framework on which the combustion chamber is suspended. That necessitates a considerable technical outlay during the manufacture and installation of the once-through steam generator, which becomes larger as the overall height of the once-through steam generator becomes larger.

Fossil-fuel-fired steam generators are normally constructed for a particular type and quality of fuel and for a certain output range. That means that the combustion chamber of the steam generator, in its main dimensions, that is length, width and height, is adapted to combustion properties and ash properties of the predetermined fuel and to the predetermined output range. Therefore, each steam generator, with its fuel and output range associated therewith, has an individual structure of the combustion chamber with regard to the main dimensions.

If the combustion chamber of a steam generator is to be reconstructed, for example for a new output range and/or a fuel of a different type or quality, recourse may be had to planning documents of already-existing steam generators. With the aid of the documents, the main dimensions of the combustion chamber are then normally adapted to the requirements of the steam generator to be reconstructed. However, despite that simple measure, the structure of a steam generator for newly predetermined boundary conditions, due to the complexity of the systems taken as a basis, still involves a comparatively high design cost. That applies in particular when the respective steam generator is to have an especially high overall efficiency.

SUMMARY OF THE INVENTION

It is accordingly an object of the invention to provide a fossil-fuel-fired steam generator, which overcomes the hereinafore-mentioned disadvantages of the heretofore-known devices of this general type, which has a concept for a combustion chamber that permits an especially simple structure for a certain type and quality of fuel and for a predetermined output range and which requires especially little outlay in terms of manufacture and installation.

With the foregoing and other objects in view there is provided, in accordance with the invention, a steam generator, comprising a modular combustion space including a first module having at least one first combustion chamber and a second module having at least one second combustion chamber. The at least one first and at least one second combustion chambers each have a respective number of burners for fossil fuel and define a substantially horizontal main flow direction for heating gas. A common horizontal gas flue is provided, into which the at least one first and at least one second combustion chambers lead. A vertical gas flue is disposed downstream of the common horizontal gas flue on the heating-gas side.

The invention is based on the idea that a concept for the combustion chamber of the steam generator should permit an especially simple construction for a certain type and quality of fuel and for a predetermined output range of the steam generator. This is the case if a modular type of construction of the combustion chamber is provided. In this case, modules of the same kind prove to be especially simple to handle and permit an especially high degree of flexibility with regard to a desired rating of the combustion chamber. In addition, it should be especially simple to increase or reduce the size of the combustion chamber through the use of the modules.

However, a combustion chamber constructed for a throughflow of the heating gas in an approximately vertical direction requires a framework which is technically very complicated to construct. That framework would also have to be appropriately adapted with considerable outlay if the steam generator was retrofitted. In contrast thereto, a framework which is to be constructed with comparatively little technical outlay can be accompanied by an especially low overall height of the steam generator. A combustion chamber given a horizontal type of construction and having a first and a second combustion chamber therefore offers an especially simple concept for a steam generator with a modular construction. In this case, the burners, in both the first and the second combustion chambers, are disposed at the level of the horizontal gas flue in the combustion-chamber wall. The heating gas therefore flows through the combustion chambers in an approximately horizontal main flow direction during operation of the steam generator.

The burners are advantageously disposed on an end wall of the first combustion chamber and on an end wall of the second combustion chamber, that is on that containing wall of the respective first and second combustion chambers which is opposite the outflow opening to the horizontal gas flue. A steam generator with such a construction can be adapted to the burn-out length of the fuel in an especially simple manner. The burn-out length of the fuel in this case refers to the heating-gas velocity in the horizontal direction at a certain average heating-gas temperature, multiplied by a burn-out time $t_A$ of the fuel. In this case, the maximum burn-out length for the respective steam generator is obtained during full load, that is the "full-load operation" of the steam generator. The burn-out time $t_A$ is in turn the time which, for example, a pulverized-coal grain of average size requires in order to burn out completely at a certain average heating-gas temperature.

In order to keep material damage and undesirable contamination of the horizontal gas flue, for example due to a yield of molten ash at a high temperature, at an especially low level, a length L of the first and the second combustion chambers, which length is defined by a distance from the end wall to an inlet region of the horizontal gas flue, is advantageously at least equal to the burn-out length of the fuel during full-load operation of the steam generator. This horizontal length L of the first combustion chamber and of the second combustion chamber will generally be larger than the height of the respective first or second combustion chamber, measured from a funnel top edge up to the top of the combustion chamber.

In an advantageous refinement, the length L (specified in m) of the first and the second combustion chambers is selected for especially favorable utilization of the heat of combustion of the fossil fuel as a function of a BMCR value W (specified in kg/s) of the steam generator, of a number N of combustion chambers, of the burn-out time $t_A$ (specified in s) of the fuel and of an outlet temperature TBRK (specified in °C.) of the heating gas from the combustion chambers. The term BMCR stands for Boiler Maximum Continuous Rating. BMCR is the term normally used internationally for the maximum continuous output of a steam generator. That also corresponds to the design output, which is the output during full-load operation of the steam generator. In this case, at a given BMCR value W and a given number of combustion chambers N, the length L of the first and the second combustion chambers is approximately the larger value of two functions (1) and (2):

$$L(W, N, t_A)=(C_1+C_2\cdot W/N)\cdot t_A \quad (1)$$

$$L(W, N, T_{BRK})=(C_3\cdot T_{BRK}+C_4)(W/N)+C_5(T_{BRK})^2+C_6\cdot T_{BRK}+C_7 \quad (2)$$

where:

$C_1$=8 m/s and $C_2$=0.0057 m/kg and $C_3=-1.905\cdot 10^{-4}$(m·s)/(kg °C.) and $C_4$=0.286(s·m)/kg and $C_5=3\cdot 10^{-4}$ m/(°C.)$^2$ and $C_6$=−0.842 m/°C. and $C_7$=603.41 m.

In this case, "approximately" is to be understood as an admissible deviation by +20%/−10% from the value defined by the respective function.

The end wall of the first combustion chamber and the end wall of the second combustion chamber as well as the side walls of the respective first and second combustion chambers of the horizontal gas flue and/or of the vertical gas flue are advantageously formed from vertically disposed evaporator tubes or steam-generator tubes which are welded to one another in a gas-tight manner. A flow medium can be admitted in a parallel manner to a respective number of evaporator or steam-generator tubes.

In order to provide especially good heat transfer of the heat of the first and the second combustion chambers to the flow medium conducted in the respective evaporator tubes, a number of evaporator tubes each advantageously has ribs on their inside forming a multi-start thread. In this case, a helix angle a between a plane perpendicular to the tube axis and the sides of the ribs disposed on the inside of the tube is advantageously less than 60°, preferably less than 55°.

This is because, in a heated evaporator tube constructed as an evaporator tube without inner ribbing, that is a "smooth tube", the wetting of the tube wall which is required for especially good heat transfer, can no longer be maintained starting from a certain steam content. If there is a lack of wetting, there may be a tube wall which is dry in places. The transition to such a dry tube wall leads to a type of critical stage of the heat transfer with impaired heat-transfer behavior. Therefore, in general, the tube-wall temperatures at this location increase to an especially pronounced extent. However, in an inner-ribbed tube, this critical stage of the heat transfer, compared with a smooth tube, does not occur until there is a steam mass content >0.9, that is just before the end of the evaporation. This may be attributed to the swirl which the flow undergoes due to the spiral-shaped ribs. Due to their different centrifugal forces, the water portion is separated from the steam portion and forced onto the tube wall. As a result, the wetting of the tube wall is maintained up to high steam contents, so that there are already high flow velocities at the location of the heat-transfer critical stage. Despite the heat-transfer critical stage, this produces relatively good heat transfer and consequently low tube-wall temperatures.

A number of evaporator tubes of the combustion chamber advantageously have measures for reducing the throughflow of the flow medium. In this case, it proves to be especially favorable if the measures are provided as choke devices. Choke devices may, for example, be components built into the evaporator tubes. These built-in components reduce the inside diameter of the tube at a location in the interior of the respective evaporator tube. At the same time, measures for reducing the throughflow in a line system including a plurality of parallel lines also prove to be advantageous. The flow medium can be fed through the line system to the evaporator tubes of the combustion chamber. In this case, for example, choke fittings may be provided in one line or in a plurality of lines of the line system. With such measures for reducing the throughflow of the flow medium through the evaporator tubes, the rate of flow of the flow medium through individual evaporator tubes can be adapted to the respective heating in the combustion chamber. As a result, temperature differences of the flow medium at the outlet of the evaporator tubes can additionally be kept especially small in an especially reliable manner.

Respective adjacent evaporator or steam-generator tubes are advantageously welded to one another in a gastight manner through metal bands or "fins". The width of the fins influences the heat input into the steam-generator tubes. The fin width is therefore preferably adapted as a function of the position of the respective evaporator or steam-generator tubes in the steam generator to a heating profile which can be predetermined on the gas side. In this case, the heating profile specified may be a typical heating profile determined from empirical values or a rough estimation, such as a stepped heating profile, for example. Due to the suitably selected fin widths, a heat input into all of the evaporator or steam-generator tubes, even during greatly varying heating of various evaporator or steam-generator tubes, can be achieved in such a way that temperature differences at the outlet of the respective evaporator or steam-generator tubes are kept especially small. In this way, premature material fatigue is reliably prevented. As a result, the steam generator has an especially long service life.

In a further advantageous refinement of the invention, the inside diameter of a number of evaporator tubes of the respective first and second combustion chambers is selected as a function of the respective position of the evaporator tubes in the respective first and second combustion chambers. In this way, a number of evaporator tubes of the respective first and second combustion chambers can be adapted to a heating profile which can be predetermined on the gas side. As a result, temperature differences at the outlet of the evaporator tubes of the respective first and second combustion chambers are kept small in an especially reliable manner.

A common inlet collector system is advantageously connected in each case upstream of a number of evaporator tubes, which are connected in parallel and which are assigned to the first or the second combustion chamber, for the flow medium, and a common outlet collector system is advantageously connected in each case downstream of the evaporator tubes. This embodiment of a steam generator permits a reliable pressure balance between the evaporator tubes connected in parallel and thus permits an especially favorable distribution of the flow medium during the flow through the evaporator tubes. In this case, a line system provided with choke fittings may be connected upstream of the respective inlet collector system. As a result, the rate of flow of the flow medium through the inlet collector system and the evaporator tubes connected in parallel can be set in an especially simple manner.

The evaporator tubes of the end wall of the respective first or second combustion chambers are advantageously connected on the flow-medium side upstream of the evaporator tubes of the side walls of the respective first or second combustion chambers. As a result, especially favorable cooling of the end wall of the respective first and second combustion chambers is ensured.

A number of superheater heating surfaces which are disposed approximately perpendicularly to the main flow direction of the heating gas and the tubes of which are connected in parallel for a throughflow of the flow medium, are advantageously disposed in the horizontal gas flue. These superheater heating surfaces, which are disposed in a suspended type of construction and are also designated as bulkhead heating surfaces, are mainly heated in a convective manner and are connected on the flow-medium side downstream of the evaporator tubes of the respective first and second combustion chambers. As a result, especially favorable utilization of the heating-gas heat supplied through the burners is ensured.

The vertical gas flue advantageously has a number of convection heating surfaces which are formed from tubes disposed approximately perpendicularly to the main flow direction of the heating gas. These tubes of a convection heating surface are connected in parallel for a throughflow of the flow medium. These convection heating surfaces are also mainly heated in a convective manner.

The vertical gas flue advantageously has an economizer in order to also ensure especially effective complete utilization of the heat of the heating gas.

The advantages achieved by the invention reside in particular in the fact that, due to the concept of a modular construction of the combustion chamber of the steam generator, the latter requires especially little outlay in terms of design and manufacture. Instead of the respective restructuring of the dimensioning of the combustion chamber, the intention now is only to add or remove one or more combustion chambers when constructing the combustion chamber of the steam generator for a predetermined output range and/or a certain fuel quality. In this case, starting from a certain rating of the steam generator, instead of one combustion chamber to be reconstructed, two or more combustion chambers having a smaller output may be connected in parallel on the gas side upstream of a common horizontal gas flue.

Other features which are considered as characteristic for the invention are set forth in the appended claims.

Although the invention is illustrated and described herein as embodied in a fossil-fuel-fired steam generator, it is nevertheless not intended to be limited to the details shown, since various modifications and structural changes may be made therein without departing from the spirit of the invention and within the scope and range of equivalents of the claims.

The construction and method of operation of the invention, However, together with additional objects and advantages thereof will be best understood from the following description of specific embodiments when read in connection with the accompanying drawings.

DESCRIPTION OF THE PREFERRED EMBODIMENTS

Figure 1:
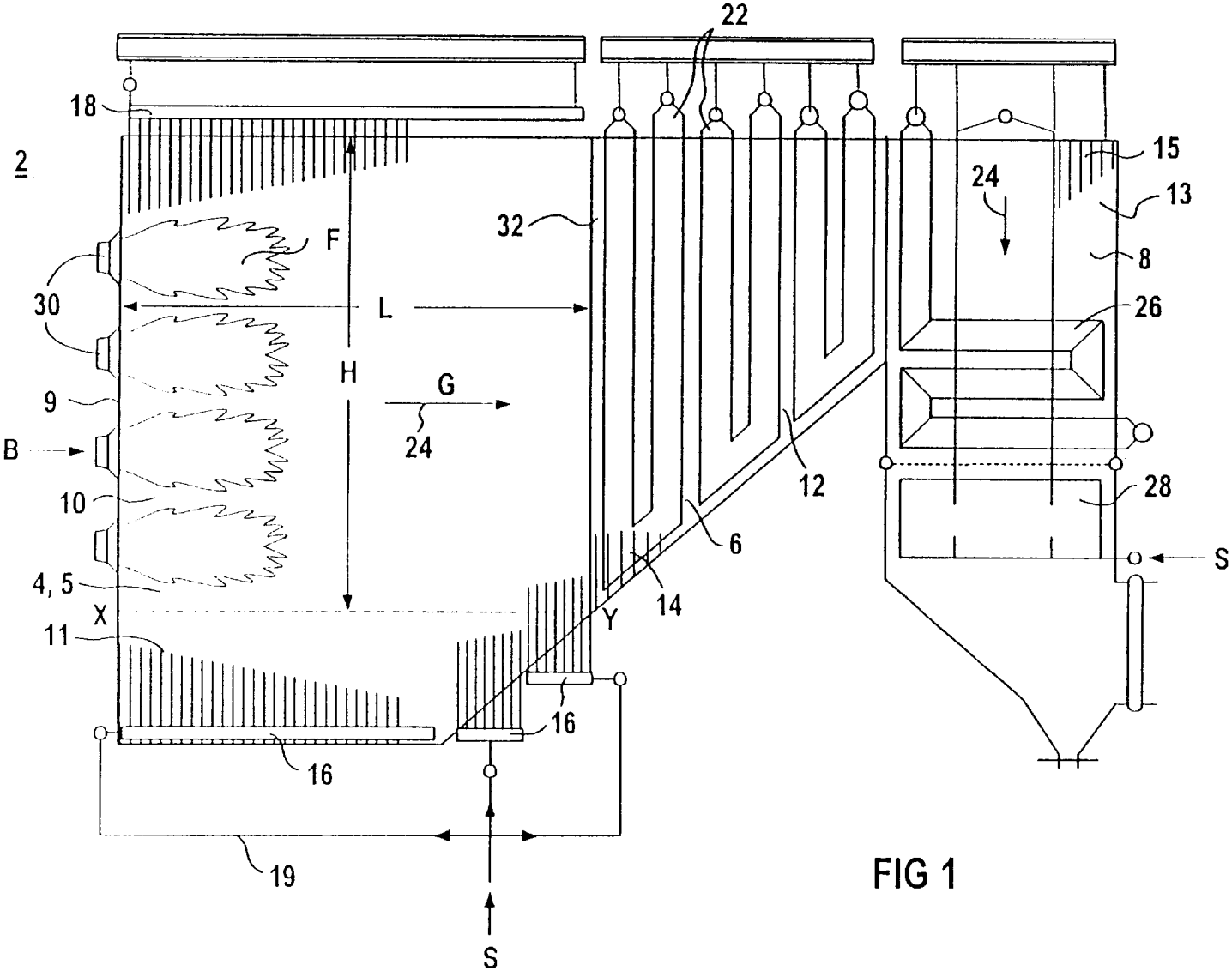
FIG. 1 is a diagrammatic, lengthwise, side-elevational view of a fossil-fuel-fired steam generator with a twin-flue type of construction.

Referring now in detail to the figures of the drawings, in which parts corresponding to one another are provided with the same reference numerals, and first, particularly, to FIG. 1 thereof, there is seen a steam generator 2 associated with a power plant which is not shown in any greater detail, but which also includes a steam turbine plant. In this case, steam generated in the steam generator is used to drive the steam turbine, which in turn drives a generator for the generation of electricity. Current generated by the generator in this case is intended for feeding into an interconnected or separate network. Furthermore, a partial quantity of the steam may also be branched off for feeding into an external process connected to the steam turbine plant. That process may be a heating process.

The fossil-fuel-fired steam generator 2 according to FIG. 1 is advantageously constructed as a once-through steam generator. The steam generator 2 includes a modular combustion space having a first module with at least one first horizontal combustion chamber 4 and a second module with at least one second horizontal combustion chamber 5. Only one of the combustion chambers can be seen due to the side view of the steam generator 2 shown in FIG. 1. A common horizontal gas flue 6, which opens into a vertical gas flue 8, is connected downstream of the combustion chambers 4 and 5 of the steam generator 2, on the heating-gas side.

An end wall 9 and side walls 10 of the respective first combustion chamber 4 and second combustion chamber 5 are in each case formed from vertically disposed evaporator tubes 11 welded to one another in a gastight manner. It is possible in each case for a flow medium S to be admitted in a parallel manner to a number of evaporator tubes 11. In addition, side walls 12 of the horizontal gas flue 6 and side walls 13 of the vertical gas flue 8 may also be formed from respective vertically disposed steam-generator tubes 14 and 15, which are welded to one another in a gastight manner. In this case, the flow medium S can likewise be admitted in a parallel manner in each case to the steam-generator tubes 14, 15.

Figure 2:
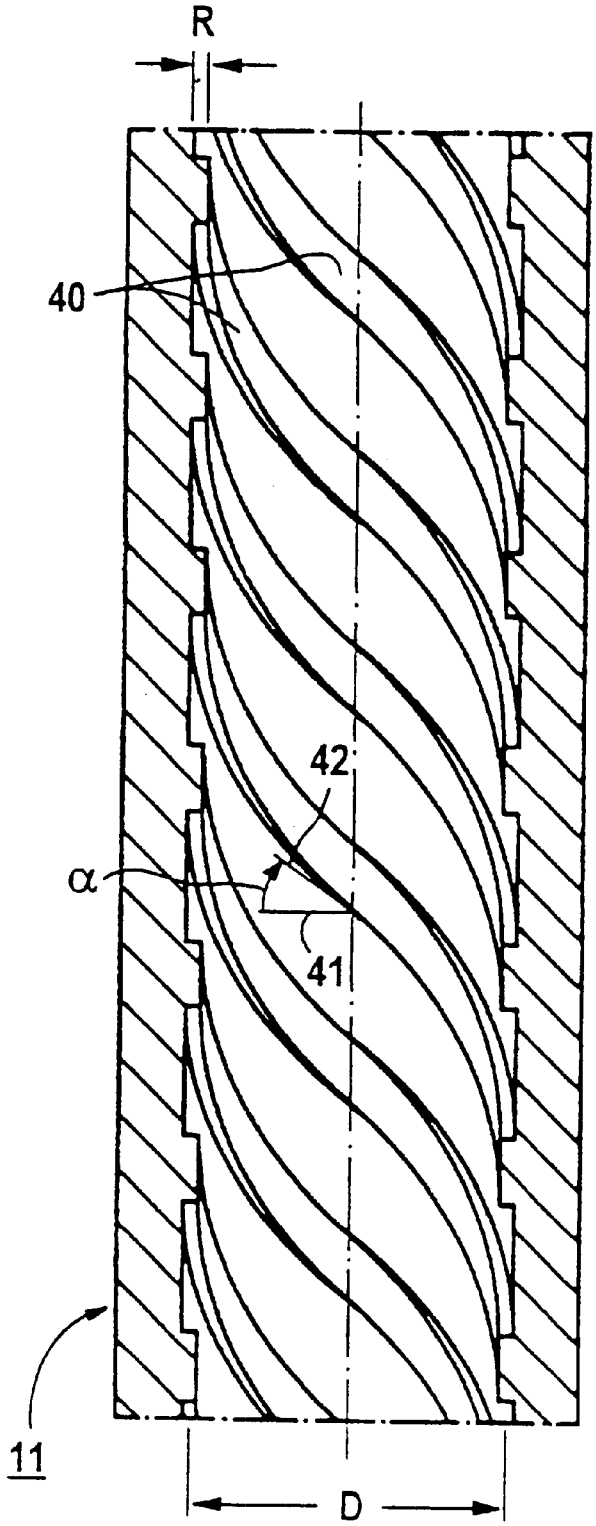
FIG. 2 is an enlarged, longitudinal-sectional view of an individual, respective, evaporator or steam-generator tube.

The evaporator tubes 11 have ribs 40 on their inside which form a type of multi-start thread and have a rib height R, as is shown in FIG. 2. In this case, a helix angle $\alpha$ between a plane 41 perpendicular to the tube axis and sides or edges 42 of the ribs 40 disposed on the inside of the tube, is less than 55°. As a result, especially high heat transfer from the inner wall surface of the evaporator tubes 11 to the flow medium S conducted in the evaporator tubes 11 and at the same time especially low temperatures of the tube wall, are achieved.

Adjacent evaporator or steam-generator tubes 11, 14, 15 are respectively welded to one another in a gastight manner through the use of fins in a non-illustrated manner. This is because the heating of the respective evaporator or steam-generator tubes 11, 14, 15 can be influenced by a suitable selection of the fin width. The respective fin width is therefore adapted as a function of the position of the respective evaporator and steam-generator tubes 11, 14, 15 in the steam generator 2 to a heating profile which can be predetermined on the gas side. In this case, the heating profile may be a typical heating profile determined from empirical values or by a rough estimation. As a result, temperature differences at the outlet of the respective evaporator or steam-generator tubes 11, 14, 15 are kept especially small even when the heating of the respective evaporator or steam-generator tubes 11, 14, 15 varies greatly. In this way, material fatigue is reliably prevented, which ensures a long service life of the steam generator 2.

An inside diameter D of the evaporator tubes 11 of the respective combustion chamber 4 or 5 is selected as a function of the respective position of the evaporator tubes 11 in the combustion chamber 4 or 5. In this way, the steam generator 2 is adapted to the varying intensity of the heating of the evaporator tubes 11. This construction of the evaporator tubes 11 of the respective combustion chamber 4 or 5 ensures, in an especially reliable manner, that temperature differences at the outlet of the evaporator tubes 11 are kept especially small.

An inlet collector system 16 for the flow medium S is connected in each case on the flow-medium side upstream of a number of evaporator tubes 11 of the side walls 10 of the respective combustion chamber 4 or 5 and an outlet collector system 18 is connected in each case on the flow-medium side downstream of the evaporator tubes 11. In this case, the inlet collector system 16 includes a number of inlet collectors connected in parallel. A line system 19 is provided in order to feed the flow medium S into the inlet collector system 16 of the evaporator tubes 11 of the respective combustion chamber 4 or 5. The line system 19 includes a plurality of lines which are connected in parallel and which are each connected to one of the inlet collectors of the inlet collector system 16. It is thus possible to provide a pressure balance of the evaporator tubes 11 which are connected in parallel. This pressure balance produces an especially favorable distribution of the flow medium S during the flow through the evaporator tubes 11.

Some of the evaporator tubes 11 are provided with non-illustrated choke devices as a measure for reducing the throughflow of the flow medium S. The choke devices are constructed as perforated plates reducing the inside diameter D of the tube and, during operation of the steam generator 2, bring about a reduction in the rate of flow of the flow medium S in the evaporator tubes 11 heated to a lower degree. As a result, the rate of flow of the flow medium S is adapted to the heating. Furthermore, one or more non-illustrated lines of the line system 19 are provided with choke devices, in particular choke fittings, as measures for reducing the rate of flow of the flow medium S in a number of the evaporator tubes 11 of the respective combustion chamber 4 or 5.

With regard to the tubing of the first and second combustion chambers 4, 5, it is to be taken into account that the heating of the individual evaporator tubes 11 which are welded to one another in a gastight manner varies greatly during operation of the steam generator 2. The construction of the evaporator tubes 11 with regard to their inner ribbing, fin connection to adjacent evaporator tubes 11 and their inside diameter D is therefore selected in such a way that all of the evaporator tubes 11, despite different heating, have approximately the same outlet temperatures, and adequate cooling of the evaporator tubes 11 for all of the operating states of the steam generator 2 is ensured. This is ensured, in particular, by the steam generator 2 being constructed for a comparatively low mass flow density of the flow medium S flowing through the evaporator tubes 11. In addition, a suitable selection of the fin connections and the inside diameters D of the tubes achieves the effect that the proportion of the friction pressure loss to the total pressure loss is so low that a natural circulation behavior occurs. In that regard, the flow through evaporator tubes 11 heated to a greater degree is greater than the flow through evaporator tubes 11 heated to a lesser degree. This achieves the effect that the evaporator tubes 11 in the vicinity of the burners, which are heated to a comparatively high degree, specifically absorb approximately just as much heat, relative to the mass flow, as the evaporator tubes 11 at the combustion-chamber end, which are heated to a comparatively low degree. A further measure for adapting the throughflow of the evaporator tubes 11 of the respective combustion chamber 4 or 5 to the heating is to fit chokes in some of the evaporator tubes 11 or in some of the lines of the line system 19. In this case, the internal ribbing of the evaporator tubes 11 is constructed in such a way that adequate cooling of the walls of the evaporator tubes is ensured. Therefore, with the above-mentioned measures, all of the evaporator tubes 11 have approximately the same outlet temperatures.

The evaporator tubes 11 of the end walls 9 of the respective combustion chamber 4 or 5 are in each case connected on the flow-medium side upstream of the evaporator tubes 11 of the side walls 10 of the respective combustion chamber 4 or 5. This is done in order to achieve a favorable throughflow characteristic of the flow medium S through containing walls of the combustion chamber 4 and thus especially good utilization of the heat of combustion of a fossil fuel B.

The horizontal gas flue 6 has a number of superheater heating surfaces 22 which are constructed as bulkhead heating surfaces and are disposed in a suspended type of construction approximately perpendicularly to a main flow direction 24 of a heating gas G, and tubes thereof are in each case connected in parallel for a throughflow of the flow medium S. The superheater heating surfaces 22 are mainly heated in a convective manner and are connected on the flow-medium side downstream of the evaporator tubes 11 of the respective combustion chamber 4 or 5.

The vertical gas flue 8 has a number of convection heating surfaces 26 which can be heated mainly in a convective manner and are formed from tubes disposed approximately perpendicularly to the main flow direction 24 of the heating gas G. These tubes are in each case disposed in parallel for a throughflow of the flow medium S. In addition, an economizer 28 is disposed in the vertical gas flue 8. On the outlet side, the vertical gas flue 8 opens into a further heat exchanger, e.g. into an air preheater, and from there into a stack through a dust filter. The components connected downstream of the vertical gas flue 8 are not shown in detail in FIG. 1.

Figure 3:
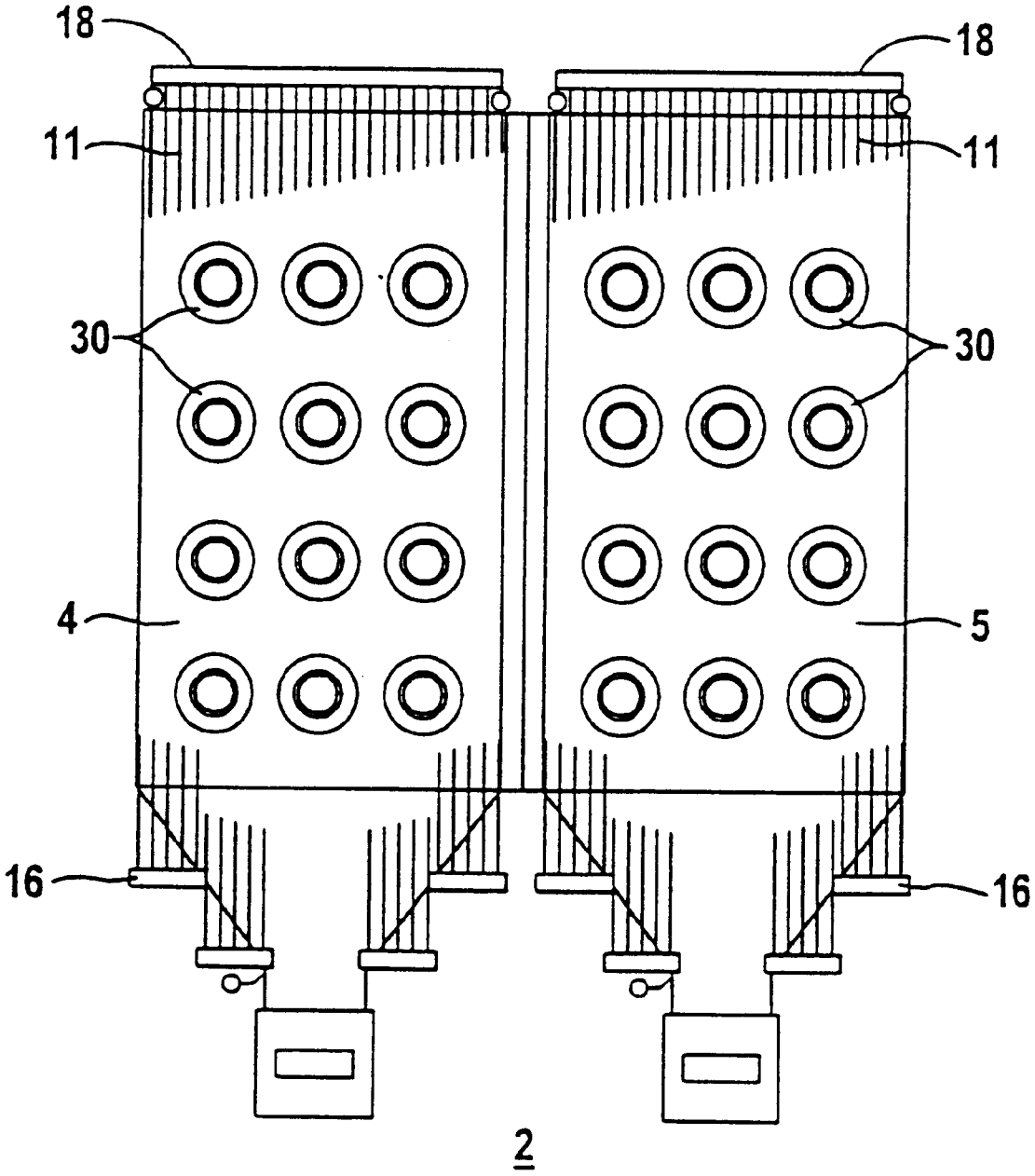
FIG. 3 is a front-elevational view of the steam generator.

The steam generator 2 is given a horizontal type of construction with an especially low overall height and can therefore be set up with especially little outlay in terms of manufacture and installation. To this end, the respective combustion chambers 4 and 5 of the steam generator 2 have a number of burners 30 for the fossil fuel B. These burners 30 are disposed on the end wall 9 of the respective combustion chamber 4 or 5 at the level of the horizontal gas flue 6, as can be seen in FIG. 3.

In order to ensure that especially complete burn-out of the fossil fuel B is brought about to achieve an especially high efficiency, and to ensure that material damage to the first superheater heating surface, as viewed from the heating-gas side, of the horizontal gas flue 6 and contamination of the same, for example due to the yield of molten ash at high temperature, is prevented in an especially reliable manner, lengths L of the combustion chambers 4 and 5 are selected in such a way that they exceed a burn-out length of the fuel B during full-load operation of the steam generator 2. In this case, the length L is a given distance from the end wall 9 of the respective combustion chamber 4 or 5 to an inlet region 32 of the horizontal gas flue 6. The burn-out length of the fuel B in this case is defined as the heating-gas velocity in the horizontal direction at a certain average heating-gas temperature, multiplied by a burn-out time $t_A$ of the fuel B. The maximum burn-out length for the respective steam generator 2 is obtained during full-load operation of the steam generator 2. The burn-out time $t_A$ of the fuel B is in turn the time which, for example, a pulverized-coal grain of average size requires for complete burn-out at a certain average heating-gas temperature.

In order to ensure especially favorable utilization of the heat of combustion of the fossil fuel B, the lengths L (specified in m) of the respective combustion chambers 4 and 5 are suitably selected as a function of an outlet temperature $T_{BRK}$ (specified in °C.) of the heating gas G from the respective combustion chamber 4 or 5, of the burn-out time $t_A$ (specified in s) of the fossil fuel B, of the BMCR value W (specified in kg/s) of the steam generator 2, and of the number N of combustion chambers 4, 5. In this case, BMCR stands for Boiler Maximum Continuous Rating. BMCR is a term normally used internationally for the maximum continuous output of a steam generator. This also corresponds to the design output, that is the output during full-load operation of the steam generator. In this case, this horizontal length L of the combustion chambers 4 and 5 is greater than the height H of the respective combustion chamber 4 or 5. The height H in this case is measured from a funnel top edge of the respective combustion chamber 4 or 5, indicated in FIG. 1 by a line with end points X and Y, up to a top of the combustion chamber. The length L is determined only once and then applies to each of the respective N combustion chambers 4 and 5. In this case, the length L of the two combustion chambers 4 and 5 is approximately determined through two functions (1) and (2):

$$L(W, N, t_A)=(C_1+C_2W/N)\cdot t_A \quad (1)$$

$$L(W, N, T_{BRK})=(C_3\cdot T_{BRK}+C_4)(W/N)+C_5(T_{BRK})^2+C_6\cdot T_{BRK}+C_7 \quad (2)$$

where:

$C_1$=8 m/s and $C_2$=0.0057 m/kg and $C_3=-1.905\cdot 10^{-4}$(m·s)/(kg °C.) and $C_4$=0.286(s·m)/kg and $C_5=3\cdot 10^{-4}$ m/(°C.)$^2$ and $C_6$=−0.842 m/°C. and $C_7$=603.41 m.

The expression "approximately" in this case refers to an admissible deviation by +20%/−10% from a value defined by the respective function. In this case, for any desired but fixed BMCR value W of the steam generator 2, the larger value from the functions (1) and (2) for the length L of the combustion chambers 4 and 5 always applies.

Figure 4:
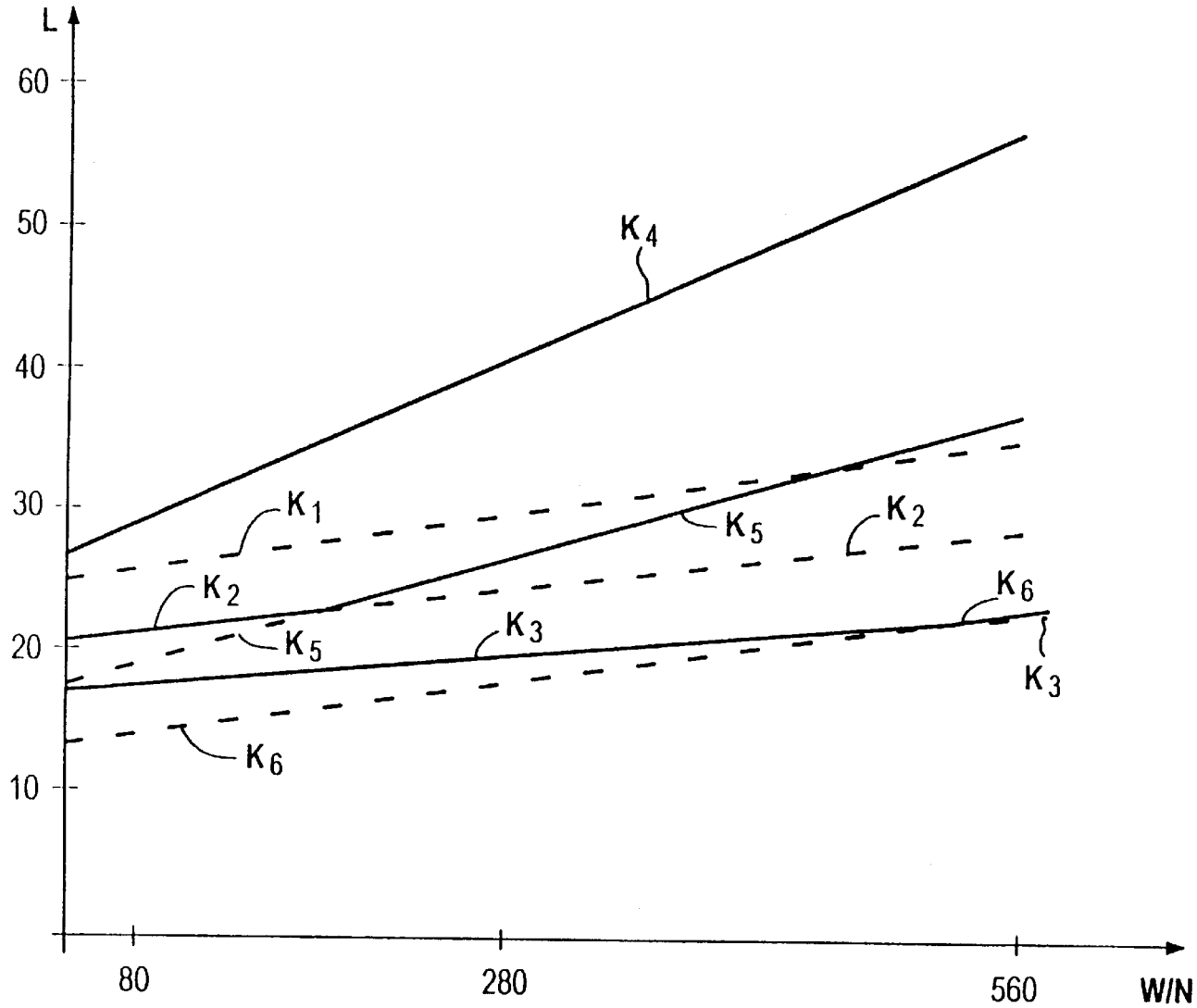
FIG. 4 is a coordinate system with curves $K_1$ to $K_6$.

As an example for a calculation of the length L of the respective combustion chambers 4 and 5, that is N=2, as a function of the BMCR value W of the steam generator 2, six curves $K_1$ to $K_6$ are plotted in a coordinate system according to FIG. 4. In this case, the following parameters are assigned to the respective curves:

$K_1$: $t_A$=3s according to (1), $K_2$: $t_A$=2.5s according to (1), $K_3$: $t_A$=2s according to (1), $K_4$: $T_{BRK}$=1200° C. according to (2), $K_5$: $T_{BRK}$=1300° C. according to (2), and $K_6$: $T_{BRK}$=1400° C. according to (2).

The curves $K_1$ and $K_4$ are therefore to be used to determine the lengths L of the respective combustion chambers 4 and 5, which always have the same length L, for example for a burn-out time $t_A$=3s and an outlet temperature $T_{BRK}$=1200° C. of the heating gas G from the respective combustion chamber 4 or 5. The length L is derived therefrom, at a predetermined BMCR value W of the steam generator 2 with N=2 for the combustion chambers 4 and 5, as follows:

L=29m according to $K_4$ from W/N=80 kg/s,

L=34m according to $K_4$ from W/N=160 kg/s,

L=57m according to $K_4$ from W/N=560 kg/s.

The curves $K_2$ and $K_5$, for example, are to be used for the burn-out time $t_A$=2.5s and the outlet temperature $T_{BRK}$=1300° C. of the heating gas G from the respective combustion chamber 4 or 5. The length L of the combustion chambers 4 and 5 is derived therefrom at N=2 and a predetermined BMCR value W of the steam generator 2, as follows:

L=21m according to $K_2$ from W/N=80 kg/s,

L=23m according to $K_2$ and $K_5$ from W/N=180 kg/s,

L=37m according to $K_5$ from W/N=560 kg/s.

The curves $K_3$ and $K_6$, for example, are assigned to the burn-out time $t_A$=2s and the outlet temperature $T_{BRK}$=1400° C. of the heating gas G from the combustion chamber. The length L of the combustion chambers 4 and 5 is derived therefrom, at N=2 and a predetermined BMCR value W of the steam generator 2, as follows:

L=18m according to $K_3$ from W/N=80 kg/s,

L=21m according to $K_3$ and $K_6$ from W/N=465 kg/s,

L=23m according to $K_6$ from W/N=560 kg/s.

Flames F of the burners 30 are oriented horizontally during operation of the steam generator 2. Due to the type of construction of the respective combustion chamber 4 or 5, a flow of the heating gas G produced during the combustion is thus produced in the approximately horizontal main flow direction 24. The heating gas G passes through the common horizontal gas flue 6 into the vertical gas flue 8, which is oriented approximately toward the base, and leaves the vertical gas flue 8 in the direction of a non-illustrated stack.

The flow medium S entering the economizer 28 passes through the convection heating surfaces disposed in the vertical gas flue 8 into the inlet collector system 16 of the respective combustion chamber 4 or 5 of the steam generator 2. The evaporation, and if need be partial superheating, of the flow medium S take place in the vertically disposed evaporator tubes 11, which are welded to one another in a gastight manner, of the respective combustion chamber 4 or 5, of the steam generator 2. The steam produced in the process, or a water/steam mixture, is collected in the outlet collector system 18 for the flow medium S. From there, the steam or the water/steam mixture passes into the walls of the horizontal gas flue 6 and of the vertical gas flue 8 and from there in turn into the superheater heating surfaces 22 of the horizontal gas flue 6. Further superheating of the steam is effected in the superheater heating surfaces 22. This steam is then supplied for utilization, for example for driving a steam turbine.

Especially little outlay in terms of manufacture and installation of the steam generator 2 is ensured due to the especially low overall height and compact type of construction thereof. At the same time, the design of the steam generator 2 for a predetermined output range and/or a certain quality of the fossil fuel B requires a very small technical outlay. In addition, due to the modular concept of the combustion chamber, starting from a certain rating, two or more combustion chambers having a smaller output may be connected in parallel upstream of the common horizontal gas flue 6, instead of one combustion chamber.

We claim:

1. A steam generator, comprising:

a modular combustion space including a first module having at least one first combustion chamber and a second module having at least one second combustion chamber;

said at least one first and at least one second combustion chambers each having a respective number of burners for fossil fuel and defining a substantially horizontal main flow direction for heating gas;

a common horizontal gas flue into which said at least one first and at least one second combustion chambers lead, said common horizontal gas flue having a heating-gas side; and a vertical gas flue downstream of said common horizontal gas flue on said heating-gas side.

2. The steam generator according to claim 1, wherein said modules of said combustion space are of the same kind.

3. The steam generator according to claim 1, wherein said at least one first combustion chamber and said at least one second combustion chamber have side walls formed of vertically disposed evaporator tubes gas-tightly welded to one another for receiving a flow medium fed in parallel to a number of said evaporator tubes.

4. The steam generator according to claim 3, wherein a number of said evaporator tubes have an inner surface with ribs forming a multi-start thread.

5. The steam generator according to claim 4, wherein said ribs have sides, and said evaporator tubes have a tube axis defining a plane perpendicular to said tube axis, said plane and said sides forming a helix angle therebetween of less than 60°.

6. The steam generator according to claim 4, wherein said ribs have sides, and said evaporator tubes have a tube axis defining a plane perpendicular to said tube axis, said plane and said sides forming a helix angle therebetween of less than 55°.

7. The steam generator according to claim 3, wherein a number of said evaporator tubes each have a respective choke device.

8. The steam generator according to claim 3, wherein a number of said evaporator tubes of one of said at least one first combustion chamber and said at least one second combustion chamber have an inside diameter selected as a function of a position of said evaporator tubes in a respective one of said at least one first combustion chamber and said at least one second combustion chamber.

9. The steam generator according to claim 3, including a common inlet collector system connected upstream of a number of said evaporator tubes of one of said at least one first combustion chamber and of said at least one second combustion chamber for receiving the flow medium in parallel on a flow-medium side, and a common outlet collector system connected downstream of said evaporator tubes on the flow-medium side.

10. The steam generator according to claim 1, wherein said horizontal gas flue has side walls formed of vertically disposed steam-generator tubes gas-tightly welded to one another for receiving a flow medium in parallel.

11. The steam generator according to claim 1, wherein said vertical gas flue has side walls formed of vertically disposed steam-generator tubes gas-tightly welded to one another for receiving a flow medium in parallel.

12. The steam generator according to claim 1, including a line system for feeding a flow medium into said evaporator tubes of one of said combustion chambers, said line system having a number of choke devices for reducing a through-flow of the flow medium.

13. The steam generator according to claim 12, wherein said choke devices are choke fittings.

14. The steam generator according to claim 1, wherein at least one of said at least one first and at least one second combustion chambers, said horizontal gas flue and said vertical gas flue have adjacent evaporator or steam-generator tubes gas-tightly welded to one another by fins having a fin width selected as a function of a respective position of said evaporator or steam-generator tubes therein.

15. The steam generator according to claim 1, including a number of superheater heating surfaces suspended in said horizontal gas flue.

16. The steam generator according to claim 1, including a number of convection heating surfaces disposed in said vertical gas flue.

17. A steam generator, comprising:

a combustion space including at least one first and at least one second combustion chamber each having an end wall and defining a substantially horizontal main flow direction for heating gas;

a common horizontal gas flue into which said at least one first and at least one second combustion chambers lead, said common horizontal gas flue having a heating-gas side and having an inlet region disposed at a given distance from said end wall of said at least one first combustion chamber and said end wall of said at least one second combustion chamber;

a vertical gas flue connected downstream of said common horizontal gas flue on said heating-gas side;

a number of burners for a fossil fuel, the fossil fuel having a burn-out length during full-load operation of the steam generator, said burners respectively disposed on said end wall of said at least one first combustion chamber and on said end wall of said at least one second combustion chamber; and said at least one first and at least one second combustion chambers having a length being defined by said given distance and being at least equal to the burn-out length.

18. The steam generator according to claim 17, wherein said length of said at least one first combustion chamber and of said at least one second combustion chamber is selected as a function of at least one of a BMCR value W, a number N of said combustion chambers, a burn-out time $t_A$ of said burners and an outlet temperature $T_{BRK}$ of the heating gas from said at least one first combustion chamber and said at least one second combustion chamber, substantially according to the following two functions:

$$L(W, N, t_A)=(C_1+C_2\cdot W/N)\cdot t_A$$

$$L(W, N, T_{BRK})=(C_3\cdot T_{BRK}+C_4)(W/N)+C_5(T_{BRK})^2+C_6\cdot T_{BRK}+C_7$$

where:

$C_1$=8 m/s and $C_2$=0.0057 m/kg and $C_3=-1.905\cdot 10^{-4}$ (m·s)/(kg °C.) and $C_4$=0.286 (s·m)/kg and $C_5=3\cdot 10^{-4}$ m/(°C.)$^2$ and $C_6$=−0.842 m/°C. and $C_7$=603.41 m.

19. The steam generator according to claim 17, wherein said end wall of said at least one first combustion chamber and said end wall of said at least one second combustion chamber are both formed of vertically disposed evaporator tubes gas-tightly welded to one another for receiving a flow medium in parallel.

20. The steam generator according to claim 19, wherein a number of said evaporator tubes have an inner surface with ribs forming a multi-start thread.

21. The steam generator according to claim 20, wherein said ribs have sides, and said evaporator tubes have a tube axis defining a plane perpendicular to said tube axis, said plane and said sides forming a helix angle therebetween of less than 60°.

22. The steam generator according to claim 20, wherein said ribs have sides, and said evaporator tubes have a tube axis defining a plane perpendicular to said tube axis, said plane and said sides forming a helix angle therebetween of less than 55°.

23. The steam generator according to claim 19, wherein a number of said evaporator tubes each have a respective choke device.

24. The steam generator according to claim 19, wherein a number of said evaporator tubes of one of said at least one first combustion chamber and said at least one second combustion chamber have an inside diameter selected as a function of a position of said evaporator tubes in a respective one of said at least one first combustion chamber and said at least one second combustion chamber.

25. The steam generator according to claim 19, including a common inlet collector system connected upstream of a number of said evaporator tubes of one of said at least one first combustion chamber and of said at least one second combustion chamber for receiving the flow medium in parallel on a flow-medium side, and a common outlet collector system connected downstream of said evaporator tubes on the flow-medium side.

26. The steam generator according to claim 17, wherein said at least one first combustion chamber and said at least one second combustion chamber have side walls formed of vertically disposed evaporator tubes gas-tightly welded to one another for receiving a flow medium fed in parallel to a number of said evaporator tubes.

27. The steam generator according to claim 26, wherein a number of said evaporator tubes have an inner surface with ribs forming a multi-start thread.

28. The steam generator according to claim 27, wherein said ribs have sides, and said evaporator tubes have a tube axis defining a plane perpendicular to said tube axis, said plane and said sides forming a helix angle therebetween of less than 60°.

29. The steam generator according to claim 27, wherein said ribs have sides, and said evaporator tubes have a tube axis defining a plane perpendicular to said tube axis, said plane and said sides forming a helix angle therebetween of less than 55°.

30. The steam generator according to claim 26, wherein a number of said evaporator tubes each have a respective choke device.

31. The steam generator according to claim 26, wherein a number of said evaporator tubes of one of said at least one first combustion chamber and said at least one second combustion chamber have an inside diameter selected as a function of a position of said evaporator tubes in a respective one of said at least one first combustion chamber and said at least one second combustion chamber.

32. The steam generator according to claim 26, including a common inlet collector system connected upstream of a number of said evaporator tubes of one of said at least one first combustion chamber and of said at least one second combustion chamber for receiving the flow medium in parallel on a flow-medium side, and a common outlet collector system connected downstream of said evaporator tubes on the flow-medium side.

33. The steam generator according to claim 26, wherein said evaporator tubes of said end walls of at least one of said at least one first combustion chamber and of said at least one second combustion chamber are respectively connected on a flow-medium side upstream of said evaporator tubes of said side walls of at least one of said at least one first combustion chamber and of said at least one second combustion chamber.

34. The steam generator according to claim 17, wherein said horizontal gas flue has side walls formed of vertically disposed steam-generator tubes gas-tightly welded to one another for receiving a flow medium in parallel.

35. The steam generator according to claim 17, wherein said vertical gas flue has side walls formed of vertically disposed steam-generator tubes gas-tightly welded to one another for receiving a flow medium in parallel.

36. The steam generator according to claim 17, including a line system for feeding a flow medium into said evaporator tubes of one of said combustion chambers, said line system having a number of choke devices for reducing a through-flow of the flow medium.

37. The steam generator according to claim 36, wherein said choke devices are choke fittings.

38. The steam generator according to claim 17, wherein at least one of said at least one first and at least one second combustion chambers, said horizontal gas flue and said vertical gas flue have adjacent evaporator or steam-generator tubes gas-tightly welded to one another by fins having a fin width selected as a function of a respective position of said evaporator or steam-generator tubes therein.

39. The steam generator according to claim 17, including a number of superheater heating surfaces suspended in said horizontal gas flue.

40. The steam generator according to claim 17, including a number of convection heating surfaces disposed in said vertical gas flue.

* * * * *